US005762270A

United States Patent [19]

Kearby et al.

[11] Patent Number: 5,762,270

[45] Date of Patent: Jun. 9, 1998

[54] SPRINKLER UNIT WITH FLOW STOP

[75] Inventors: Don M. Kearby, Vista; Richard M. Dunn, Encinitas; Mike L. Clark, San Marcos, all of Calif.

[73] Assignee: Hunter Industries Incorporated, San Marcos, Calif.

[21] Appl. No.: 569,925

[22] Filed: Dec. 8, 1995

[51] Int. Cl.[6] ..... B05B 15/10

[52] U.S. Cl. ..... 239/205; 239/242; 239/580

[58] Field of Search ..... 239/237, 240, 239/241, 242, 246, 203, 204, 205, 206, DIG. 1, 390, 391, 392, 394, 569, 583, 541, 580

[56] References Cited

U.S. PATENT DOCUMENTS

| | | | |
|---|---|---|---|
| 3,323,725 | 6/1967 | Hruby, Jr. | 239/205 |
| 3,383,047 | 5/1968 | Hauser | 239/580 |
| 4,562,962 | 1/1986 | Hartman | 239/200 |
| 4,729,511 | 3/1988 | Citron | 239/205 |
| 4,796,804 | 1/1989 | Weiss | 239/1 |
| 4,892,252 | 1/1990 | Bruninga | 239/205 |
| 5,335,857 | 8/1994 | Hagon | 239/204 |
| 5,465,752 | 11/1995 | Higgins | 239/533.15 |

*Primary Examiner*—Andres Kashnikow
*Assistant Examiner*—Lisa Ann Douglas
*Attorney, Agent, or Firm*—Baker, Maxham, Jester & Meador

[57] ABSTRACT

A sprinkler unit comprises a housing having an inlet for connecting to a source of water, an outlet, passage means connecting the inlet to the outlet, a nozzle detachably mounted in the outlet for distributing a stream of water outward from the housing, and a valve in the passage selectively operable for selectively stopping flow of water through the passage means to the nozzle and an actuator operable from the exterior of the housing for selectively operating the valve.

18 Claims, 2 Drawing Sheets

SPRINKLER UNIT WITH FLOW STOP

BACKGROUND OF THE INVENTION

The present invention relates to irrigation sprinklers and pertains particularly to an improved sprinkler unit having flow stop means.

Many regions of the world today use irrigation systems for the artificial distribution of water. One of the most widely used irrigation systems, particularly where water is not abundant or plentiful, is the sprinkler system wherein a plurality of sprinkler units are positioned about a land area for distributing water over the surface of the land area. Such systems are widely used in most developed countries for lawns, golf courses, playing fields and many field crops.

Most sprinkler units currently used have replaceable nozzles wherein different nozzles may be selected and mounted in the sprinkler unit to achieve desired range and rate of coverage. A given irrigation system may have many different sprinkler units of the same type, with each having many different nozzles. It may also be desirable or necessary to change and/or adjust nozzles or other features of a sprinkler unit for a given area to obtain an optimum precipitation rate or area of coverage. It is normally necessary to shut off a sprinkler unit to adjust or replace the nozzle. This requires that the entire system of sprinkler units on a common valve be shut off, and it requires the operator to walk back and forth between the control valve or control box and the sprinkler unit of interest, or have a helper who stays near the control box or control valve to cut off the flow of water when desired.

Accordingly, it is desirable that a sprinkler unit be available having a means for shutting off flow through the unit to enable repair or adjustment of the unit without the necessity of shutting down the entire system of sprinkler units.

SUMMARY AND OBJECTS OF THE INVENTION

Accordingly, it is a primary object of the present invention to provide a sprinkler unit with means for stopping flow of water through the unit to enable adjustments and repairs.

In accordance with the primary aspect of the present invention, a sprinkler unit is provided with valve means in a main through-passage for stopping flow of water through the sprinkler unit to enable replacement of the nozzle and other adjustments or repairs. As applied to pop-up units, the sprinkler unit is left in the extended position while water is shut off to better enable access to the unit.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
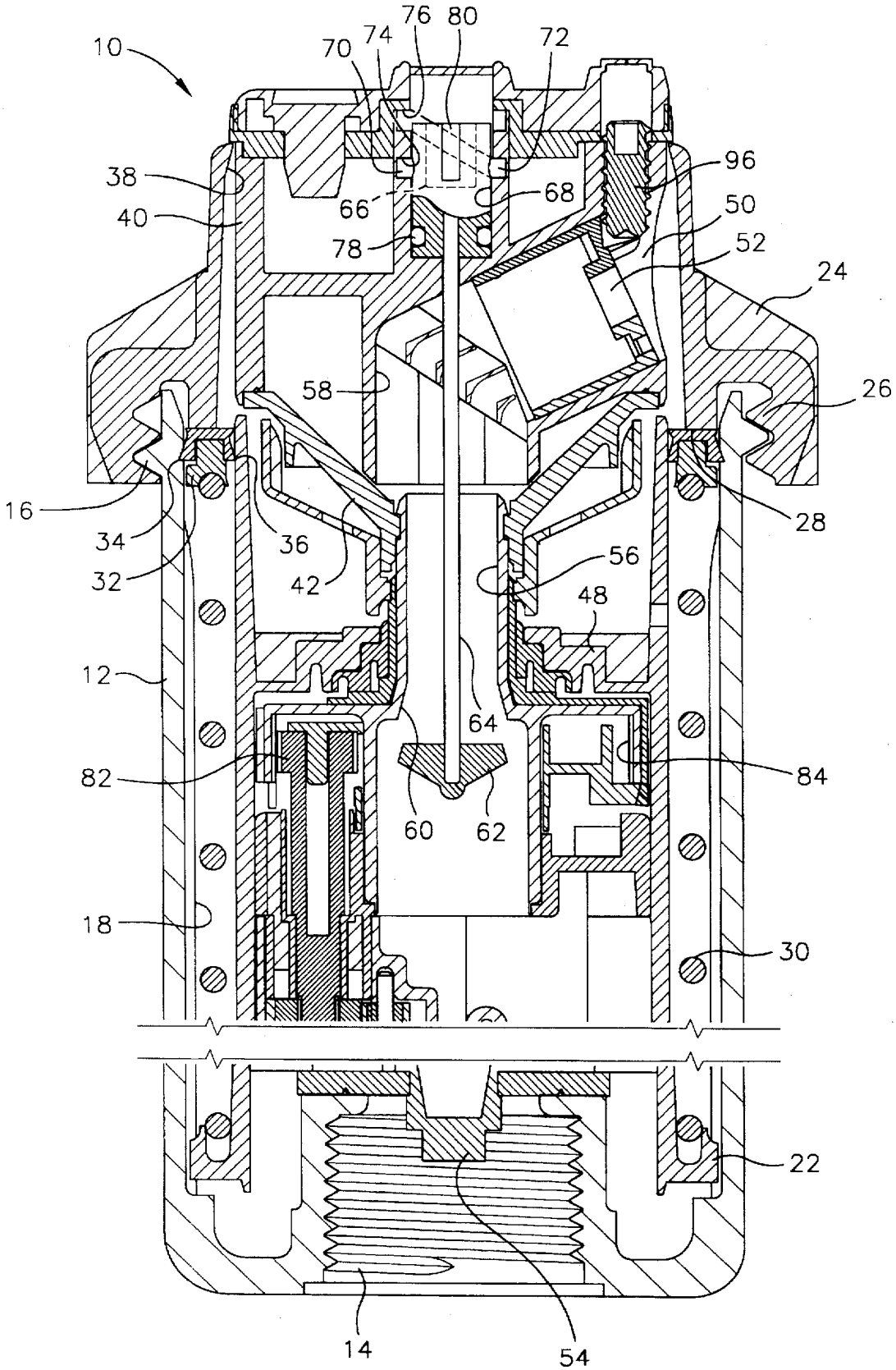
FIG. 1 is a side elevation view in section of a sprinkler unit embodying a preferred embodiment of the invention showing the shutoff valve in the open position.
Figure 2:
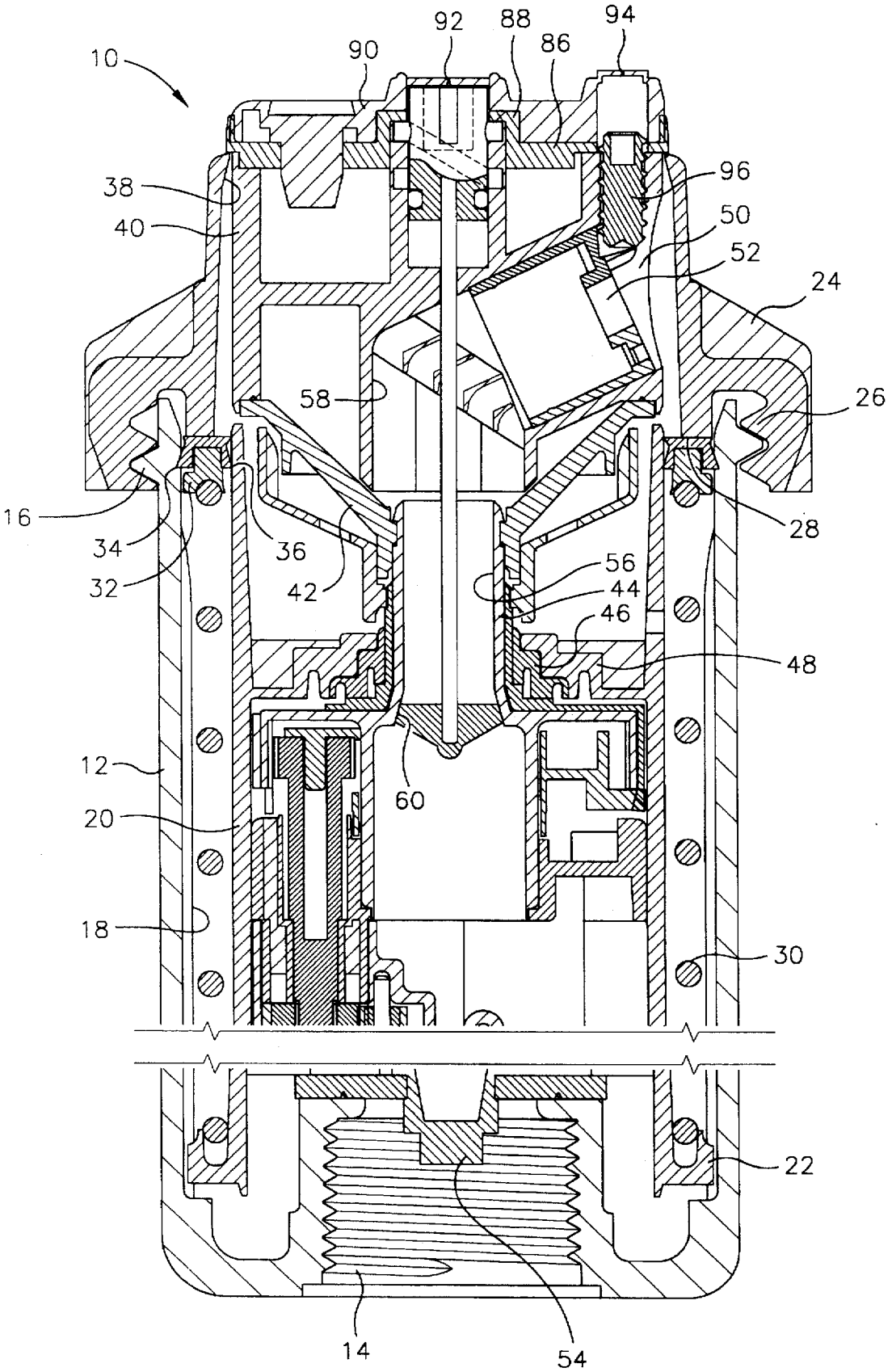
FIG. 2 is a view like FIG. 1 showing the shutoff valve in the closed position.

Referring to the drawings, particularly to FIGS. 1 and 2, there is illustrated a side elevation view in section of a sprinkler unit embodying the present invention. The illustrated sprinkler unit is of the type represented and disclosed for example in U.S. Pat. No. 4,568,024, entitled "Oscillating Sprinkler", granted Feb. 4, 1986 to the assignee of the subject application, said patent being incorporated herein by reference as though fully set forth. The sprinkler unit is turbine driven by a water turbine (not shown) through a gear train that is reversible and has an adjustable arc. Certain units may be made full circle with or without a reversing drive. Other sprinkler units are variable arc from about forty degrees up to about three-hundred sixty degrees.

The sprinkler unit designated generally by the numeral 10 comprises an outer or stationary housing 12 having a threaded inlet at 14 for threadably mounting to a riser or other suitable connection for a source of pressurized water. The outer housing 12 is provided with a plurality of internal ribs 18 and includes an upper end having threads 16 for receiving or mounting a retainer cap as will be described. The housing 12 has an upper outlet end which includes external threads 16 for cooperating with a retaining cap as will be described for retaining an extensible inner housing. A series of vertical or longitudinally extending ribs 18 is formed on the inner surface of the housing 12 to aid in guiding and orienting an internal or inner housing 20 which is reciprocally mounted within the outer housing 12 on a radially extending flange 22 at the lower end thereof having teeth or serrations in engagement with the ribs 18.

The inner housing 20 is retained in place in the bore of the outer housing by a retaining cap 24 having internal threads 26 cooperatively and threadably engaging threads 16 on the outer housing. The cap 24 includes an annular shoulder 28 which captures and retains an elongated compression spring 30 biased between radial flange 22 at the lower end of housing 20 and annular guide and retaining ring 32 at the upper end thereof. A seal 34 is captured between the ring 32 and shoulder 28 of cap 24. The seal has an inner lip 36 for sealingly engaging the outer surface of the inner housing 20 for sealing it against the leakage of water. The retainer cap 24 has a central bore 38 forming a through-bore through which the inner housing assembly extends and retracts. The inner housing includes a rotating distributor head 40 mounted on an upper end of a rotating shaft assembly comprising an upper conical member 42 mounted on an upper end of a central hollow shaft assembly 44 which is rotatably mounted in a stepped bore 46 in housing wall 48.

The overall housing has a through passage forming a flow passage between inlet 14 and an outlet 50 defining a nozzle receiving socket in which is detachably mounted a nozzle 52. A check valve at the lower end of the outer housing 12 prevents backflow in the passage-way and opens to permit the flow of water into and through the passage-way, including a through bore 56 in central drive shaft member 44 with an outlet portion 58 extending upward and outward at an angle in the head 40.

A valve seat 60 is formed by a tapered portion between different diameter portions of the passage formed by the central tubular shaft 44. A valve member 62 adapted to sealingly engage and seat in seat 60 is mounted on a valve actuating rod 64 connecting the valve to an actuating member 66. The actuating member 66 is cylindrical in configuration and mounted within a cylindrical bore 68 of the sprinkler head 40. The cylindrical member has radially extending pins or cam followers 70 and 72 extending, radially outward from opposite sides thereof and extending into a pair of semi-circular spiral cam grooves 74 and 76. An O-ring seal 78 seals the actuating member against water leakage.

A tool-coupling slot 80 which may be in the form of a screwdriver slot or a key-like slot for receiving a tool for rotating the actuating member 66 is formed in the upper end of the actuating member.

During normal operation of the sprinkler unit the valve is in the fully opened position, as shown in FIG. 1. However, when it is desired to close off the flow of water such as to work on the sprinkler unit or for other purposes, the valve actuator is rotated to the position as shown in FIG. 2, fully closing the passage and closing off the water to the nozzle 52. If the water pressure is on, the inner housing will be fully extended from the outer housing such that access to the nozzle 52 or other features or components of the sprinkler unit is available to the operator. The valve can also be utilized to partially restrict the flow of water through the passage and thereby adjust the volume of water through the sprinkler unit. This can effect both the water volume as well as the reach of the sprinkler unit.

This flow-stop arrangement enables an operator to selectively stop the flow of water through a selective nozzle at that valve for any desired purpose. In the case of pop-up sprinkler units it leaves the sprinkler unit in the extended or Up position when water pressure is still on. This provides easy access to the nozzle for replacing it and other items for adjustment, such as arc of coverage or direction of coverage.

The illustrated invention is illustrated in a gear-driven reversible drive sprinkler unit wherein a rotary drive is provided by a well-known turbine wheel, not shown, which drives through a gear assembly or gear train which includes a pinion gear 82 driving a ring gear 84, which is an integral part of the tubular drive shaft 44. The gear train may be reversible with the arc of coverage being adjustable as in other well-known sprinkler units of assignee.

The sprinkler head 40 in the illustrated embodiment is covered by a circular cap which has a central aperture or opening 88 through which the actuator member 66 extends. An elastic cap or cover 90 may extend or mount over the cap 86 and include openings 92 for access to the adjusting or actuating member 66 as illustrated. The protective cover also includes an access opening at 94 for access to a retaining screw 96 for retaining nozzle 52 in place.

In operation the valve member is in the fully opened position as shown in FIG. 1 for normal operation. When flow through the sprinkler unit is to be stopped, a tool is inserted in slot 80 of actuator 66 and the actuator rotated 180° to close the valve in the closed position, as shown in FIG. 2. This stops the flow of water through the nozzle 52 enabling the operator to perform service on the sprinkler unit without the necessity for turning off the entire water system. The valving arrangement of the present invention also enables the partial adjustment of the valve 62 to intermediate positions between fully open and fully closed to modulate the flow of water through the sprinkler unit. This enables an adjustment of the though-put of the nozzle, as well as its reach.

While we have illustrated and described our invention by means of specific embodiments, it should be understood that numerous changes and modifications may be made therein without departing from the spirit and scope of the invention as defined in the appended claims:

We claim:

1. A sprinkler unit comprising:

a housing having a central axis and an inlet for connecting to a source of water, an outlet, passage means including a coaxial portion connecting said inlet to said outlet, said outlet having means defining a nozzle receiving socket;

a nozzle for detachably mounting in said outlet for distributing a stream of water outward from said housing; and a valve in said coaxial portion of said passage means and selectively operable for selectively stopping flow of water through said passage means to said nozzle; and actuator means on a top of said housing and extending at least partially along said coaxial portion of said passage means and operable from the top exterior of said housing for selectively operating said valve.

2. A sprinkler unit according to claim 1 wherein said passage means includes a reduced diameter portion extending coaxially of said housing and said valve engages a seat located in said portion.

3. A sprinkler unit according to claim 2 wherein said actuator means is operable to adjust said valve for constricting flow through said valve.

4. A sprinkler unit according to claim 1 wherein said sprinkler unit is an adjustable arc oscillating unit.

5. A sprinkler unit according to claim 1 wherein said actuator means comprises a cylindrical member rotatably mounted coaxially within said housing and an elongated actuating rod connecting said cylindrical member to said valve.

6. A sprinkler unit according to claim 5 wherein said actuator means includes cam means for biasing said cylindrical member axially upon rotation thereof.

7. A sprinkler unit according to claim 6 wherein said cam means comprises a spiral slot and a pin engaging said slot.

8. A sprinkler unit according to claim 7 wherein said cylindrical member comprises tool coupling means for engagement with a tool for rotating said cylindrical member.

9. A sprinkler unit according to claim 8 wherein said housing is retractably mounted in a fixed housing.

10. A sprinkler unit according to claim 8 wherein said actuator means is operable to adjust said valve for constricting flow through said valve.

11. A sprinkler unit according to claim 1 wherein said actuator means comprises cam means for biasing said valve means toward open and closed positions.

12. A sprinkler unit comprising:

a housing having a central axis, an inlet for connecting to a source of water, an outlet, a central through passage including a reduced diameter portion extending coaxially of said housing connecting said inlet to said outlet, said outlet having means defining a nozzle receiving socket;

a nozzle in said socket for distributing a stream of water outward from said housing;

a valve seat in said passage at said reduced diameter portion and a valve selectively moveable into engagement with said seat for stopping flow of water through said passage to said nozzle; and actuator means including an actuating member mounted on a top exterior of said housing and an elongated actuating rod connected to the actuating member and extending coaxially of said housing along said central passage for selectively operating said valve seat.

13. A sprinkler unit according to claim 12 wherein said actuating member comprises a cylindrical member rotatably mounted in said housing, cam means comprising a spiral slot in one of said cylindrical member and said housing and a pin on the other of said cylindrical member and said housing engaging said slot for biasing said cylindrical member axially upon rotation thereof and said valve seat being mounted on said actuating rod and moveable therewith.

14. A sprinkler unit comprising:

a housing having an inlet for connecting to a source of water, an outlet, a central through passage including a portion extending coaxially of said housing connecting said inlet to said outlet, said outlet having means defining a nozzle receiving socket;

a nozzle in said socket for distributing a stream of water outward from said housing;

a valve in said passage and selectively operable for stopping flow of water through said passage to said nozzle; and actuator, means extending coaxially of said housing and said portion of said through passage and operable from a top exterior of said housing for selectively opening and closing said valve.

15. A sprinkler unit according to claim 14 wherein said actuator means comprises a cylindrical member rotatably mounted in said housing and an elongated actuating rod connecting said cylindrical member to said valve.

16. A sprinkler unit according to claim 15 wherein said actuator means includes cam means for biasing said cylindrical member axially upon rotation thereof.

17. A sprinkler unit according to claim 16 wherein said cam means comprises a spiral slot and a pin on said cylindrical engaging said slot.

18. A sprinkler unit according to claim 17 wherein said cylindrical member comprises tool coupling means for engagement with a tool for rotating said cylindrical member.

* * * * *

US005762270C1

(12) EX PARTE REEXAMINATION CERTIFICATE (7091st)

United States Patent
Kearby et al.

(10) Number: US 5,762,270 C1
(45) Certificate Issued: Oct. 6, 2009

(54) SPRINKLER UNIT WITH FLOW STOP

(75) Inventors: Don M. Kearby, Vista, CA (US); Richard M. Dunn, Encinitas, CA (US); Mike L. Clark, San Marcos, CA (US)

(73) Assignee: Hunter Industries, Inc., San Marcos, CA (US)

Reexamination Request:
No. 90/007,255, Oct. 12, 2004

Reexamination Certificate for:

| | |
|---|---|
| Patent No.: | **5,762,270** |
| Issued: | **Jun. 9, 1998** |
| Appl. No.: | **08/569,925** |
| Filed: | **Dec. 8, 1995** |

(51) Int. Cl.
*B05B 15/10* (2006.01)

(52) U.S. Cl. ..... 239/205; 239/242; 239/580

(58) Field of Classification Search ..... None
See application file for complete search history.

(56) References Cited

U.S. PATENT DOCUMENTS

| | | | | | |
|---|---|---|---|---|---|
| 214,778 | A | | 4/1879 | King | |
| 2,256,737 | A | | 9/1941 | Englehart | |
| 2,568,171 | A | | 9/1951 | Sigmund | |
| 2,625,411 | A | | 1/1953 | Unger | |
| 2,704,650 | A | | 3/1955 | Rand | |
| 2,763,512 | A | | 9/1956 | Porter | |
| 3,007,646 | A | | 11/1961 | Gerrans | |
| 3,107,056 | A | * | 10/1963 | Hunter | 239/206 |
| 3,323,725 | A | | 6/1967 | Hruby, Jr. | |
| 3,383,047 | A | | 5/1968 | Hauser | |
| 4,182,494 | A | | 1/1980 | Wichman et al. | |
| 4,220,283 | A | * | 9/1980 | Citron | 239/205 |
| 4,393,992 | A | | 7/1983 | Strunk et al. | 239/200 |
| 4,562,962 | A | | 1/1986 | Hartman | |
| 4,568,024 | A | * | 2/1986 | Hunter | 239/242 |
| 4,729,511 | A | | 3/1988 | Citron | |
| 4,796,804 | A | | 1/1989 | Weiss | |
| 4,892,252 | A | | 1/1990 | Bruninga | |
| 5,335,857 | A | | 8/1994 | Hagon | |
| 5,465,752 | A | | 11/1995 | Higgins | |
| 5,641,122 | A | * | 6/1997 | Alkalai et al. | 239/206 |

* cited by examiner

*Primary Examiner*—Beverly M. Flanagan

(57) ABSTRACT

A sprinkler unit comprises a housing having an inlet for connecting to a source of water, an outlet, passage means connecting the inlet to the outlet, a nozzle detachably mounted in the outlet for distributing a stream of water outward from the housing, and a valve in the passage selectively operable for selectively stopping flow of water through the passage means to the nozzle and an actuator operable from the exterior of the housing for selectively operating the valve.

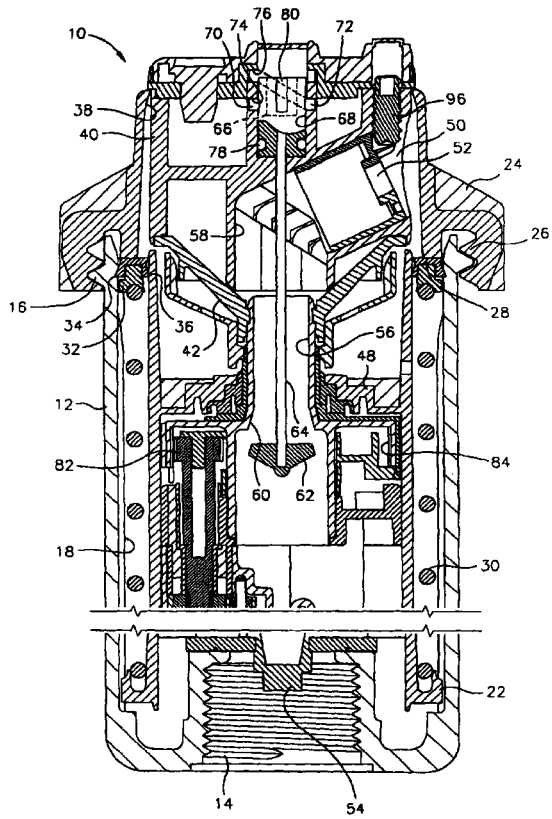

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–10, 17 and 18 is confirmed.

Claims 1–6, 11, 12 and 14–16 are cancelled.

Claim 13 is determined to be patentable as amended.

13. A sprinkler unit [according to claim 12] *comprising:*

*a housing having a central axis, an inlet for connecting to a source of water, an outlet, a central through passage including a reduced diameter portion extending coaxially of said housing connecting said inlet to said outlet, said outlet having means defining a nozzle receiving socket;*

*a nozzle in said socket for distributing a stream of water outward from said housing;*

*a valve seat in said passage at said reduced diameter portion and a valve selectively moveable into engagement with said seat for stopping flow of water through said passage to said nozzle;*

*actuator means including an actuating member mounted on a top exterior of said housing and an elongated actuating rod connected to the actuating member and extending coaxially of said housing along said central passage for selectively operating said valve; and* wherein said actuating member comprises a cylindrical member rotatably mounted in said housing, cam means comprising a spiral slot in one of said cylindrical member and said housing and a pin on the other of said cylindrical member and said housing engaging said slot for biasing said cylindrical member axially upon rotation thereof and said valve seat being mounted on said actuating rod and moveable therewith.

* * * * *